United States Patent [19]

Richey

[11] Patent Number: 4,873,775

[45] Date of Patent: Oct. 17, 1989

[54] VEHICULAR ATTACHMENT SYSTEM FOR A SNOWPLOW OR THE LIKE

[76] Inventor: Stephen J. Richey, 5708 Raintree, Parkville, Mo. 64152

[21] Appl. No.: 121,517

[22] Filed: Nov. 17, 1987

[51] Int. Cl.[4] ..... E01H 5/04

[52] U.S. Cl. ..... 37/231; 37/279

[58] Field of Search ..... 37/231, 263, 266, 270, 37/279; 172/105, 106, 129, 68–69, 76–79

[56] References Cited

U.S. PATENT DOCUMENTS

| | | | |
|---|---|---|---|
| 795,985 | 8/1905 | Kerr | 172/105 |
| 2,234,645 | 3/1941 | Hetzelt | 37/279 |
| 2,362,374 | 11/1944 | Heppner | 172/205 |
| 2,582,136 | 1/1952 | Koblas | 37/263 |
| 2,722,064 | 11/1955 | Jaffe et al. | 37/263 |
| 2,955,367 | 10/1960 | Vort | 37/263 |
| 3,477,149 | 11/1969 | Wagner | 37/279 |
| 3,608,216 | 9/1971 | Prescott | 37/231 |
| 4,024,653 | 5/1977 | Morris | 37/231 |
| 4,073,076 | 2/1978 | Fortune | 37/266 |
| 4,262,753 | 4/1981 | Vanchot | 37/231 |

FOREIGN PATENT DOCUMENTS

| | | | |
|---|---|---|---|
| 543769 | 7/1958 | Italy | 37/263 |

OTHER PUBLICATIONS

"Clear Your Drive The Easy Way", Popular Mechanics, Dec. 1971, p. 166, 190, vol. 136, No. 6.

*Primary Examiner*—Eugene H. Eickholt

*Attorney, Agent, or Firm*—Hovey, Williams, Timmons & Collins

[57] ABSTRACT

An apparatus for engagement with a vehicle is provided which allows a rotatable support wheel of the vehicle to propel the apparatus ahead of the vehicle in the direction the travel thereof. The preferred apparatus includes a snowplow blade or the like, a pair of spaced-apart mounting structures extending rearwardly from the blade, and a pair of horizontally disposed, transverse rollers rotatably coupled with respective mounting structures for engaging a forward peripheral of the front wheel of the vehicle, and elastomeric straps for holding the rollers engaged with the vehicle wheels. In use, forward motion of the vehicle wheels cause the forward peripheral portion of the wheels to engage the respective rollers and propel the apparatus forward for plowing snow or the like.

15 Claims, 2 Drawing Sheets

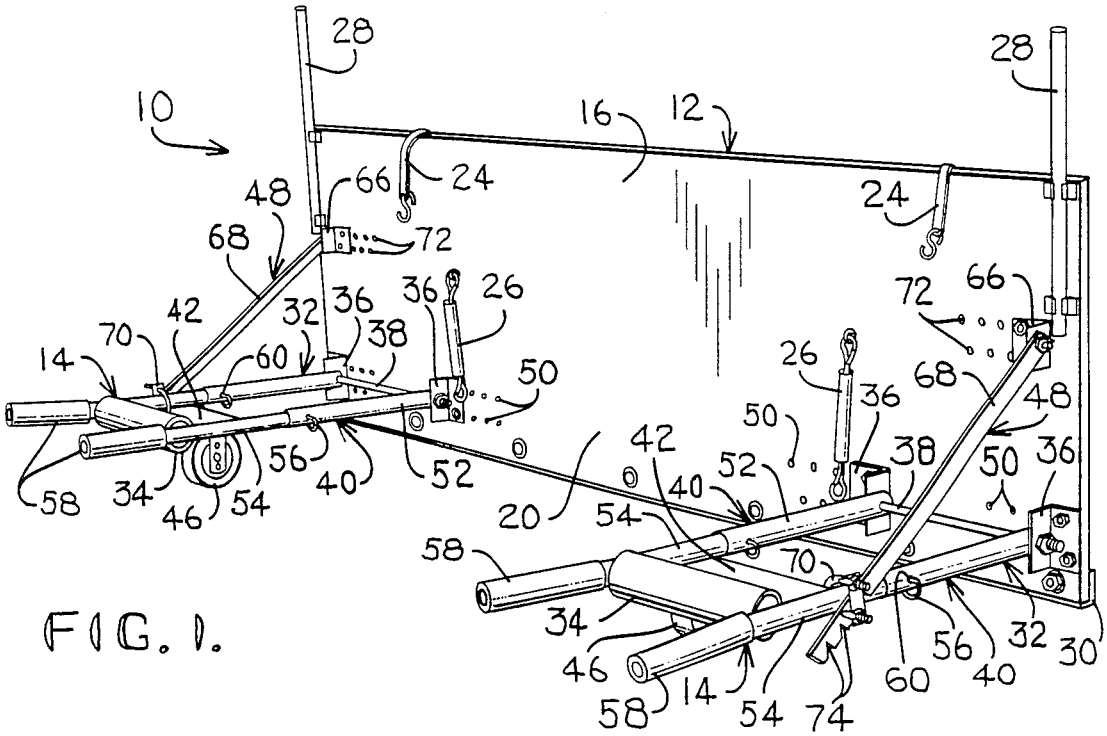
FIG. 1.
FIG. 2.
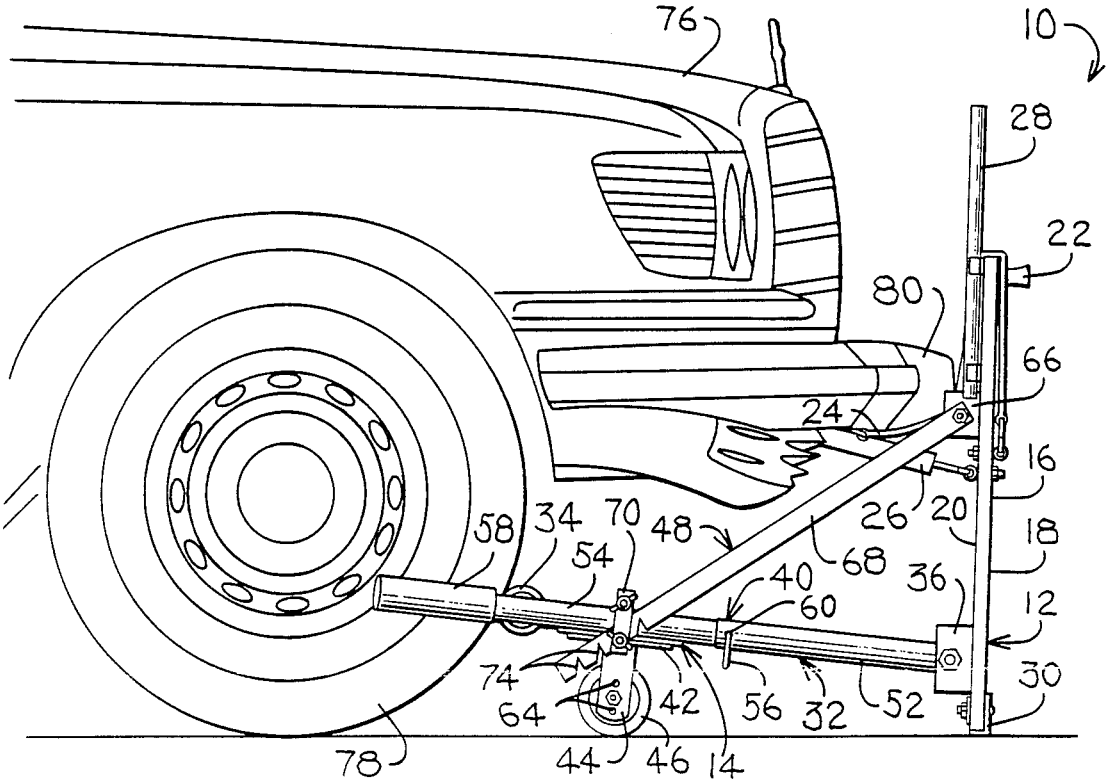

VEHICULAR ATTACHMENT SYSTEM FOR A SNOWPLOW OR THE LIKE

BACKGROUND OF THE INVENTION

1. Field of the Invention

The present invention relates to an apparatus for engagement with a rotatable support wheel of a vehicle for propelling the apparatus ahead of the vehicle in the direction of travel thereof. More particularly, the present invention relates to a snowplow blade or the like having a pair of spaced-apart rollers extending from the rear wall thereof for rotatable engagement with forward peripheral portions of the respective front wheels of the vehicle to allow the front wheels to propel the snowplow blade ahead of the vehicle.

2. Description of the Prior Art

The prior art discloses numerous mechanisms for attaching a snowplow blade or the like to the front of a vehicle such as an automobile or a pickup truck. Some of the known prior art devices provide means for connecting the snowplow blade to the front bumper of the vehicle. Such mechanisms present a problem because typical vehicular bumpers are not sturdy enough for such use and may become damaged thereby.

Other prior art devices avoid using the bumper of the vehicle for thrust purposes and instead provide means for coupling directly to the frame of the vehicle. Such devices, however, tend to be mechanically complex and difficult to install, typically requiring the installer to work under the vehicle to effect the connections with the vehicle frame. This can be especially uncomfortable in cold weather and with snow on the ground. Known prior art devices also tend to be heavy, cumbersome, and bulky for storage.

Accordingly, the prior art points out the need for a lightweight, vehicular attachment system for a snowplow or the like which avoids stress on the bumper of a vehicle, avoids the necessity for complicated, time consuming, and inconvenient connections with the frame of the vehicle, and folds compactly for storage.

SUMMARY OF THE INVENTION

The problems outlined above are solved by the vehicular attachment system in accordance with the present invention. That is to say, the invention hereof provides for a lightweight, compact system for coupling a working implement such as a snowplow blade or the like to a vehicle and which avoids potentially damaging stress on the bumper of the vehicle and cumbersome connections to the vehicle frame.

The preferred apparatus includes a working implement such as a snowplow blade or the like and an engagement means coupled with the implement for operative engagement with the forward peripheral portions of the front wheels of the vehicle. The preferred engagement means includes a pair of horizontally disposed rollers coupled respectively to the rear wall of the implement by extended mounting structures which present the rollers for engagement with the forward peripheral portion of the wheels so that when the vehicle wheels move forwardly, they impart corresponding rotation to the rollers and thereby impart corresponding movement to propel the apparatus forwardly.

Advantageously, the mounting structures space the implement forward of the front bumper of the vehicle in order to avoid any potential damage to the bumper. Elastomeric straps are also provided which extend between the blade and the bumper and/or frame of the vehicle in order to hold the rollers engaged with the wheels. The mounting structures also includes respective height wheels which can be adjusted to present the rollers at the proper height for engagement with the peripheral portion of the front wheels of the vehicle. Other preferred aspects will become apparent from the description herein.

In use, the forward wheels of the vehicle provide all of the thrust necessary to move the working implement forward and the rotatable nature of the rollers in engagement with the peripheral portion of the wheels prevents the front wheels from riding up over the rollers.

BRIEF DESCRIPTION OF THE DRAWING FIGURES

FIG. 1 is a rear perspective view of the preferred apparatus;

FIG. 2 is a side elevational view of the apparatus engaged with the front of a vehicle;

DETAILED DESCRIPTION OF THE PREFERRED EMBODIMENT

Figure 3:
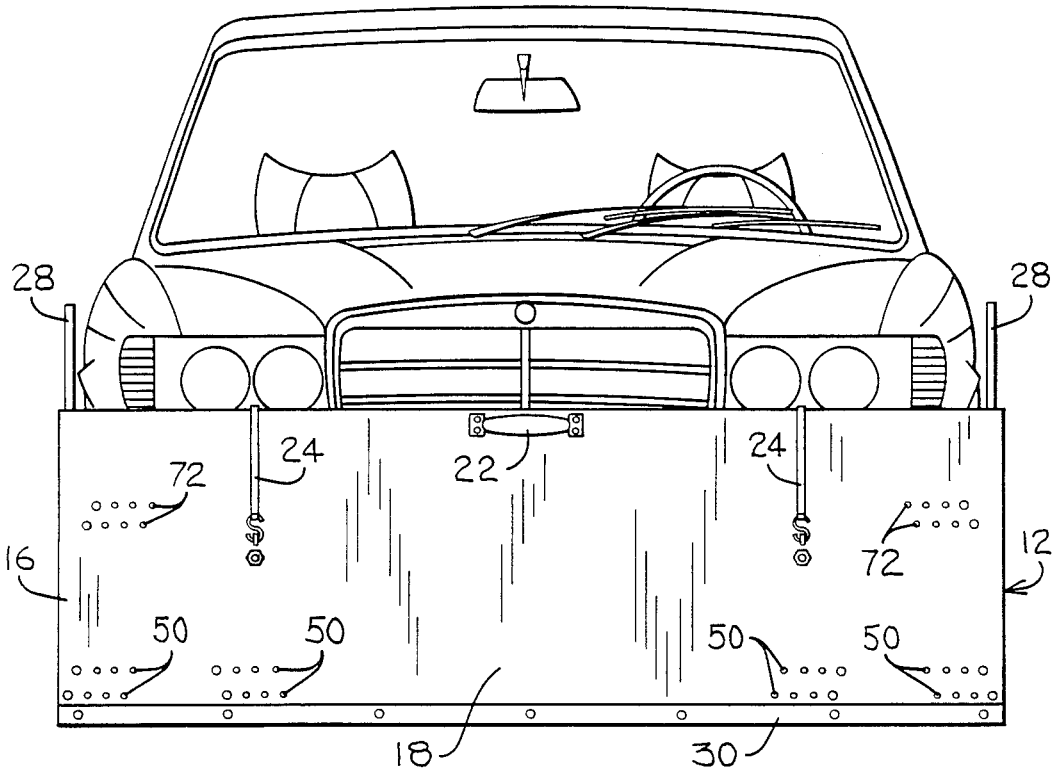
FIG. 3 is a front elevational view of the apparatus engaged with the vehicle of FIG. 2.

With reference to the drawing figures, preferred apparatus 10 includes working implement 12 and engagement means 14.

Working implement 12 can be in the form of any structure to be propelled by and ahead of a vehicle. For example, working implement 12 can be a wheeled cart, for hauling materials such as soil, sod, fireplace logs, or the like. In the preferred embodiment herein, however, working implement 12 is configured as a snowplow blade.

Implement 12 includes flat, rectangular structural body 16 preferably composed of fiberglass, synthetic resin material, or hardwood. These compositions are preferred over metal because of their relatively light weight, although metal could certainly be used as a matter of design choice.

Working implement 12 presents a forward face 18 (FIGS. 2, 3, and 4) and a rearward face 20. Forward face 18 includes handle 22 centrally located adjacent the upper edge thereof and a pair of spaced-apart elastomeric bumper straps 24 coupled to forward face 18 by means of conventional "S" hooks and eye-bolts. The ends of straps 24 also include conventional "S" hooks.

Rearward face 20 includes a pair of spaced-apart, elastomeric, frame straps 26 coupled to rearward face 20 about midway between the upper and lower edges the purpose of which is explained hereinbelow. Rearward face 20 also includes a pair of spaced-apart upright guide posts 28 conventionally coupled to rearward face 20 at opposed ends thereof and extending upwardly beyond the upper edge for visually aiding the operator of the vehicle propelling the apparatus 10 inasmuch as structural body 16 may not be visible over the hood of the vehicle.

Working implement 12 also includes angleiron wear piece 30 conventionally bolted to body 16 along the lower edge thereof as shown in the drawing figures. Wear piece 30 is replaceable if it wears out due to sliding contact with the pathway of the vehicle.

Engagement means 14 includes a pair of spaced-apart mounting structures 32 and a corresponding pair of engagement rollers 34.

Each mounting structure 32 includes a pair of spaced-apart mounting brackets 36, hinge rod 38 threaded at each end, a pair of spaced-apart extension arms 40, support plate 42, a pair of spaced-apart height wheel support brackets 44, height wheel 46, and adjustment arm assembly 48. Components 36–48 are preferably composed of steel.

Spaced-apart, L-shaped mounting brackets 36 are conventionally bolted to rearward face 20 with one leg of each extending rearwardly from rearward face 20. Additional appropriately spaced bracket mounting holes 50 are defined in structural body 16 to allow left-right adjustment of mounting structure 32 to match the front wheel spacing of the vehicle used to propel apparatus 10.

The inboard ends of extension legs 40 are located adjacent the inboard sides of the rearwardly extending legs of mounting brackets 36. Hinge rod 38 extends through appropriately defined holes in brackets 36 and in extension legs 40 in order to hingedly couple engagement means 14 to working implement 12. Conventional nuts threadably secure each end of hinge rod 38.

Extension legs 40 each include tubular base member 52, cylindrical extension member 54 slidably received in member 52, locking pin 56, and extension roller 58.

Tubular base member 52 includes locking hole 60 defined near the outboard end therethrough which is designed to register with a series of similarly defined locking holes (not shown) defined near the inboard end of tubular base member 52. The slidable nature of extension member 54 within base member 52 allows telescoping adjustment of extension legs 40. The length adjustment of legs 40 can be locked by inserting locking pin 56 through locking hole 60 and through a corresponding registered hole in extension member 54.

In the alternative, the locking arrangement using pin 56 can be replaced by an assembly wherein a nut is welded to base member 52 with a locking bolt threaded therethrough and through a corresponding hole in member 52 to tightly engage member 54 to lock in place.

Extension legs 40 also include a respective pair of guide rollers 58 rotatably coupled to the outboard ends thereof. Each guide roller 62 presents an axis of rotation which is flared outwardly at about 10-degrees relative to the axis of the corresponding extension leg 40, the purpose of which will be explained hereinbelow. Guide rollers 62 are preferably coated with non-scuffing rubber or synthetic resin material.

Rectangular support plate 42 is conventionally welded or bolted to the lower surface of the corresponding tubular base members 52 and defines the spacing between legs 40. Spaced-apart height wheel support brackets 44 are conventionally welded or bolted to the underside of support plate 42 and rotatably mount height wheel 46 therebetween. The downwardly extending leg of each height wheel support bracket 44 includes three vertically spaced-apart holes 64 defined therein which allow the height wheel 46 to be adjusted in order to adjust the height of mounting bracket 36.

Adjustment arm assembly 48 includes bracket 66, notched adjustment arm 68, and U-clamp 70.

L-shaped bracket 66 is conventionally bolted to rearward face 20 with one leg thereof extending rearwardly. An additional series of bracket holes 72 are defined in structural body 16 in correspondence with bracket mounting holes 50 so that bracket 62 can be appropriately positioned when mounting brackets 36 are shifted left or right.

Adjustment arm 68 has one end conventionally bolted to the rearwardly extending leg of bracket 66 and the other end thereof positioned within U-clamp 70 on the outboard side of extension member 54. U-clamp 70 clamps the notched end of adjustment arm 68 to extension member 54. Notches 74 defined in adjustment arm 68 aid in preventing hinged movement of mounting structure 32 when apparatus 10 is in use. However, if apparatus 10 strikes an obstruction during use, clamp 70 allows arm 68 to slip and thereby prevent damage to the various components of apparatus 10. If a locking bolt is used in place of locking pin 56 as described above, the locking bolt will also allow member 54 to slip relative to member 52 to prevent damage to apparatus 10.

Clamp 10, in the alternative, can be welded adjacent the outboard end of member 52 as a matter of design choice and convenience.

Cylindrical engagement rollers 34 are rotatably coupled between a respective pair of extension legs 40 making up each mounting structure 32 adjacent the inboard end of guide rollers 62. Rollers 34 are preferably coated with non-scuffing rubber or synthetic resin.

FIG. 2 is a side elevational view illustrating the use of apparatus 10 in connection with vehicle 76 which includes a pair of front wheels 78 (only one of which is shown) and an overhanging section including front bumper 80. To use apparatus 10, it must be initially adjusted for the particular wheel spacing, wheel size, and overhang of vehicle 76. Apparatus 10 is first placed in front of vehicle 76 with mounting structures 32 extending rearwardly toward front wheels 78 and with rearward face 20 spaced preferably about three inches in front of bumper 80.

The left-right spacing of mounting structures 32 is then adjusted to match the spacing of wheels 78 by selecting the appropriate mounting holes 50 and 72. With pin 56 removed and U-clamp 70 loosened, cylindrical extension members 54 are then shifted rearwardly until engagement rollers 34 contact the forward peripheral portions of front wheels 78. Pin 56 is then reinserted through hole 60 and the registered holes of members 54 to lock the adjusted length of extension legs 40. U-clamp 70 is then tightened to prevent hingeable movement of mounting brackets 36 relative to working implement 12.

Next, the height of engagement rollers is adjusted if needed so that rollers 34 engage the proper location on the forward peripheral portion of front wheels 78. With reference to the radii of wheels 78, this location is between horizontal and 45-degrees below horizontal. With this location, front wheels 78 can exert a force component on rollers 34 which is primary horizontal but which also includes a downward force component sufficient to prevent front wheels 78 from riding under engagement rollers 34. That is to say, if engagement rollers 34 ride too high on front wheels 78, working implement 12 will have a tendency to tip forwardly. Conversely, if engagement rollers 34 ride too low, the downward force component will put excessive strain on height wheel 46 thereby shortening its life. Preferably, engagement rollers should be located between 10 and 30 degrees below horizontal relative to the axis of rotation of front wheel 78.

After height wheel 46 has been properly adjusted by selecting the appropriate adjustment hole 64, frame straps 26 are then hooked to the frame of the vehicle at a convenient location. Many vehicles include eye-bolts located behind the front bumper used for loading and unloading the vehicle from ships. Frame straps 26 are intended to conveniently hook to these eye-bolts (not shown). Frame straps 26 help maintain engagement rollers 34 in contact with the front peripheral portion of front wheel 78 when the vehicle is turning or backing up.

Finally, bumper straps 24 are extended over the top of working implement 12 and then downwardly along rearward face 20 to hook to the lower edge of front bumper 80. Bumper straps 24 help keep wear piece 30 in contact with the pathway of the vehicle for effective snowplowing or the like and also aid in maintaining rollers 34 in contact with front wheel 78.

With apparatus 10 engaged with vehicle 76 as described above, the forward peripheral portions of wheels 78 exert forward force on engagement rollers 34 to propel apparatus 10 ahead of vehicle 76. The forward peripheral portions of wheels 78 also exert a downward force component on rollers 34 along with straps 24, 26 to keep height wheels 46 engaged with the vehicle pathway and thereby prevent forward tipping of implement 12. The rotation of wheels 78 also induce corresponding rotation of rollers 34 to prevent any traction therebetween and to prevent wheels 78 from riding over rollers 34.

Extension rollers 58 help keep mounting brackets 36 centered on the respective front wheels 78. The flared, rotatable, and non-scuffing nature of the rubber or synthetic resin coating on rollers 58 avoid any potential damage to the tire sidewalls or wheel covers of wheels 78.

The structure of apparatus 10 spaces working implement 12 forward of bumper 80 and thereby prevents any damage thereto.

FIG. 3 presents a front elevational view of apparatus 10 operably engaged with vehicle 76. Depending on the size of vehicle 76, the operator thereof may not be able to view working implement 12 over the vehicle's hood. Guide posts 28 extending upwardly from the outboard edges of implement 12 provide the operator of vehicle 76 with a guide as to the position of implement 12 during use.

Figure 4:
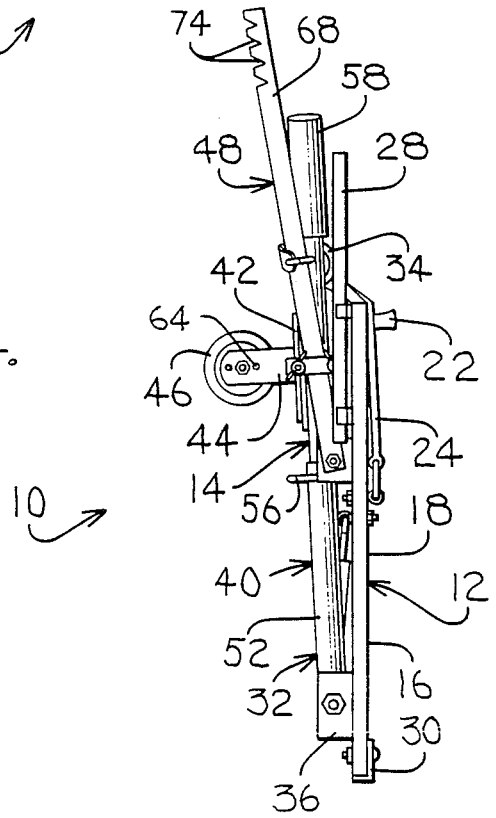
FIG. 4 is a side elevational view of the apparatus in its folded storage position.

FIG. 4 illustrates apparatus 10 in a storage position. To place apparatus 10 in the storage position, clamps 70 are loosened and mounting structures 42 rotated about hinge rod 38 until extension legs 40 contact rearward face 20 of implement 12. Straps 24 and 26 are then wrapped around mounting structures 32 to hold them in the storage position.

The lightweight nature of apparatus 10 allows it to be easily carried by handle 22 and stored, for example, by using handle 22 to hang apparatus 10 from a hook on the wall of a garage. Apparatus 10 can be placed in the storage position as illustrated in FIG. 4, without changing any of the various adjustments. Re-engagement with vehicle 76 requires only that mounting structures 32 be rotated down to the original position, clamps 70 tightened, and straps 24 and 26 reconnected.

The present invention contemplates many variations in design of the preferred apparatus 10. For example, as discussed above, working implement 12 can be any structure which is desired to be propelled ahead vehicle 76. For example, working implement 10 can be blades of different configurations and can even be a wheeled cart as a matter of design choice. Additionally, the use of the present invention is not limited to the forward portion of the vehicle, but could also be used for the rear of the vehicle for use when the vehicle is moving rearwardly. As a further example, the present invention also encompasses an embodiment in which the vehicle has only one front wheel in which case only one, centrally located, mounting structure would be required.

I claim:

1. An implement for a wheeled vehicle for allowing at least one rotatable support wheel of the vehicle to propel said implement ahead of the vehicle in the direction of travel thereof, the wheel being rotatable about an axis generally transverse to the direction of travel of the vehicle and presenting a peripheral portion located on the direction-of-travel edge of the wheel, said implement comprising:

blade means; and engagement means coupled with said blade means for engaging the peripheral portion of the wheel for receiving substantially all of the propulsion force therefrom required for propelling said blade means ahead of the vehicle during movement thereof in the direction of travel, said engagement means further including means for preventing the wheel from riding thereover during movement in the direction of travel, said engagement means further including guide alignment means for maintaining alignment of the vehicle wheel with said engagement means without connection to the vehicle.

2. The implement as set forth in claim 1, said preventing means including rotatable means for rotatably engaging the peripheral portion of the wheel.

3. The implement as set forth in claim 2, said engagement means including a selectively adjustable height wheel coupled thereto for preventing said rotatable means at a height corresponding to the peripheral portion of the wheel.

4. The implement as set forth in claim 3, said height wheel presenting said rotatable means for engagement with the peripheral portion between 10° and 30° below horizontal relative to the axis of rotation of the wheel.

5. The implement as set forth in claim 2, further including means for maintaining said rotatable means in operative engagement with the peripheral portion of the wheel.

6. The implement as set forth in claim 5, said maintaining means including elongated elastomeric straps presenting respective ends coupled with said working implement, and respective opposed ends having means for coupling with the vehicle.

7. The implement as set forth in claim 2, said rotatable means including a cylindrical roller presenting an axis of rotation, said implement including mounting structure rotatably mounting said cylindrical roller with the axis of rotation thereof disposed horizontally and above the pathway of the vehicle and generally parallel to the axis of the wheel.

8. The implement as set forth in claim 1, the vehicle presenting an overhanging portion extending ahead of the vehicle wheel in the direction of travel thereof, said implement including mounting structure for extending said blade means beyond said overhanging portion for preventing contact between said working implement and said overhanging portion of the vehicle.

9. The implement as set forth in claim 8, said mounting structure including means for selectively adjusting the length thereof.

10. The implement as set forth in claim 1, the vehicle including two coaxially mounted spaced-apart wheels, said apparatus including two of said engagement wheels for engaging respective peripheral portions of the wheels.

11. The implement as set forth in claim 10 including means for selectively adjusting the spacing between said engagement means.

12. The implement as set forth in claim 1, said blade means including a rectangular, flat, snowplow blade.

13. The implement as set forth in claim 1, further including means hingedly coupling said engagement means with said working implement for selectively rotating said engagement means toward said implement into a storage position.

14. The implement as set forth in claim 1, said blade means being composed of lightweight, non-metallic material.

15. The implement as set forth in claim 2, said guide alignment means including a pair of rotatable spaced-apart guide rollers configured for engaging respective side portions of the wheel adjacent the peripheral portion thereof.

* * * * *